US005937691A

United States Patent [19]

Kanemitsu et al.

[11] Patent Number: 5,937,691

[45] Date of Patent: Aug. 17, 1999

[54] METHOD OF FORMING AN INNER FLANGE ON A SHEET METAL MEMBER HAVING A CYLINDRICAL PORTION

[75] Inventors: Toshiaki Kanemitsu, Kobe; Kunihiro Harada, Miki; Naoki Fujii, Kobe, all of Japan

[73] Assignee: Kabushiki Kaisha Kanemitsu, Akashi, Japan

[21] Appl. No.: 09/005,714

[22] Filed: Jan. 12, 1998

[30] Foreign Application Priority Data

Jan. 27, 1997 [JP] Japan ..... 9-012561

[51] Int. Cl.[6] ..... B21D 53/26

[52] U.S. Cl. ..... 72/355.4; 72/359

[58] Field of Search ..... 72/325, 343, 352, 72/354.6, 355.2, 355.4, 358, 359, 377; 29/892, 894.362

[56] References Cited

U.S. PATENT DOCUMENTS 1,151,753 8/1915 Bates ..... 29/894.362

5,195,241 3/1993 Bradfield ..... 29/892

FOREIGN PATENT DOCUMENTS 65235 12/1946 Denmark ..... 72/359

*Primary Examiner*—Lowell A. Larson

*Attorney, Agent, or Firm*—Jones, Tullar & Cooper, P.C.

[57] ABSTRACT

The present invention relates to a method of forming an inner flange on a sheet metal member having a cylindrical portion with an inner flange 3 required in coupling of a shaft such as a pulley used in an automobile. The axial length of a boss formed on the sheet metal member is reduced by pressing the boss in the axial direction of the boss, and an excess portion produced as a result of the reduction of the axial length of the boss is gathered in one place in the axial direction of the boss, for example, the end in the axial direction of the boss to project inwardly into the inside of the boss, so that the inner flange is formed by the projected excess portion. A step of gathering the excess portion produced as a result of the reduction of the axial length of the boss can be conducted by a pressing process in which a pressing die is moved in the axial direction of the boss.

8 Claims, 6 Drawing Sheets

METHOD OF FORMING AN INNER FLANGE ON A SHEET METAL MEMBER HAVING A CYLINDRICAL PORTION

CROSS-REFERENCE TO RELATED APPLICATION

This application discloses subject matter also disclosed in co-pending application Ser. No. 09/005,822 filed on Jan. 12, 1998.

FIELD OF THE INVENTION

The present invention relates to a method of forming an inner flange on a sheet metal member having a cylindrical portion, and particularly to a method in which an inner flange required in, for example, coupling of a shaft serving as a rotating shaft to a member such as a pulley of a rotation transmission mechanism, e.g., a pulley used in an automobile or that used in usual industrial equipment can be formed by a method other than casting.

BACKGROUND OF THE INVENTION

When a shaft 5 shown in FIG. 9 is to be coupled to a member 1 having a circular shape or another shape, for example, the following structure may be employed. As shown in the figure, an end part of the shaft 5 is fitted into a cylindrical boss 2 which is formed integrally with the member 1, and the end face of the shaft 5 abuts against an inner flange 3 formed in the root part of the boss 2. A bolt 7 which is passed through a bolt through hole 4 formed by the inner flange 3 is screwed into a thread hole 6 formed in the shaft 5 to be fastened thereto. For example, this structure can be employed in the case where the member 1 is used for coupling the shaft 5 serving as a rotating shaft to a pulley of a rotation transmission mechanism such as a pulley disposed in a power steering system of an automobile or that used in usual industrial equipment.

When the member 1 shown in FIG. 9 is to be made of metal, the boss 2 and the inner flange 3 are usually formed by casting the member 1.

On the other hand, as a ring member such as a pulley and various kinds of gears, a sheet metal member which is produced by conducting a rolling process or a punching process on a flat sheet metal is used in order to reduce the weight of the ring member, enhance the toughness of the ring member, and lower the cost.

However, a ring member such as the member 1 shown in FIG. 9 in which the boss 2 has the inner flange 3 cannot be formed from a sheet metal because of a problem in production technique.

SUMMARY OF THE INVENTION

The present invention has resulted from the circumstance described above.

It is an object of the present invention to provide a useful in a sheet metal member with which a cylindrical portion such as a boss is continuously integrated, forming an inner flange on the cylindrical portion.

It is another object of the present invention to provide a method which is particularly useful in a case where an inner flange is to be formed on a basal end portion of a cylindrical portion.

It is a further object of the present invention to provide a method in which the inner flange can be formed by a pressing process.

The method of forming an inner flange on a sheet metal member having a cylindrical portion according to the present invention is a method of forming an inner flange on a sheet metal member in which, on a cylindrical portion of a sheet metal member with which the cylindrical portion is continuously integrated, an inner flange projecting into an inside of the cylindrical portion is formed, wherein an axial length of the cylindrical portion is reduced by pressing the cylindrical portion in an axial direction of the cylindrical portion, and an excess portion produced as a result of the reduction of the axial length of the cylindrical portion projects into the inside of the cylindrical portion, thereby forming the inner flange.

In the method, an excess portion produced as a result of the reduction of the axial length of the cylindrical portion is used in the formation of the inner flange projecting into an inside of the cylindrical portion. According to this configuration, an inner flange can be easily formed on the cylindrical portion which is continuously integrated with the sheet metal member. Since the excess portion is produced as a result of the reduction of the axial length of the cylindrical portion, furthermore, it is possible to produce the excess portion of a sufficient quantity by adequately setting the original axial length of the cylindrical portion. This is effective in formation of the inner flange in which the projection into the inside of the cylindrical portion has a dimension that is neither more or less.

When the method is to be executed, an arbitrary place in the axial direction of the cylindrical portion can be selected as the place into which the excess portion is to be projected. For example, the basal end part in the axial direction of the cylindrical portion may be selected as the place into which the excess portion is to be projected.

In the method of forming an inner flange on a sheet metal member having a cylindrical portion according to the present invention, the step of pressing the cylindrical portion in the axial direction to reduce the axial length of the cylindrical portion, and project the excess portion produced as a result of the reduction of the axial length of the cylindrical portion, into the inside of the cylindrical portion is conducted by a pressing process in which a pressing die is moved in the axial direction of the cylindrical portion.

It is effective to employ a method in which the pressing process is conducted under a state where the deformation of the outer peripheral face of the cylindrical portion is blocked by a first die face formed on the pressing die, or a method in which the pressing process is conducted under a state where the deformation of an end face of the basal end part of the cylindrical portion is blocked by a second die face formed on the pressing die.

The cylindrical portion may be a cylindrical boss.

In the method of forming an inner flange on a sheet metal member having a cylindrical portion according to the present invention, when the axial length of the cylindrical portion is reduced by pressing the cylindrical portion in the axial direction and the excess portion produced by the reduction of the axial length of the cylindrical portion projects into the inside of cylindrical portion, preferably, an end face of the projected part of the excess portion on the inner peripheral side is pressed against a shaping face of a core inserted into the cylindrical portion.

According to the method, the end face of the formed inner flange on the inner peripheral side is molded by the shaping face of the core.

In the method of forming an inner flange on a sheet metal member having a cylindrical portion according to the present invention, the step of pressing the cylindrical portion in the axial direction to reduce the axial length of the cylindrical portion, and project the excess portion produced as a result of the reduction of the axial length of the cylindrical portion, into the inside of the cylindrical portion is conducted in plural stages.

According to the method, the step of projecting the excess portion into the inside of the cylindrical portion can be conducted without difficulty.

According to the present invention described above, in a sheet metal member with which a cylindrical portion such as a boss is continuously integrated, an inner flange can be easily formed on the cylindrical portion. Therefore, a member having a cylindrical portion on which an inner flange is formed can be provided without using a casting process, as a lightweight sheet metal member which is tough and economical. A sheet metal member having an inner flange and produced by the present invention can be used as a pulley or a gear of a rotation transmission mechanism, for example, a pulley used in an automobile or that used in usual industrial equipment.

DETAILED DESCRIPTION OF THE PREFERRED EMBODIMENT

An embodiment of the method of the present invention will be described with reference to FIGS. 1 to 4.

Figure 1:
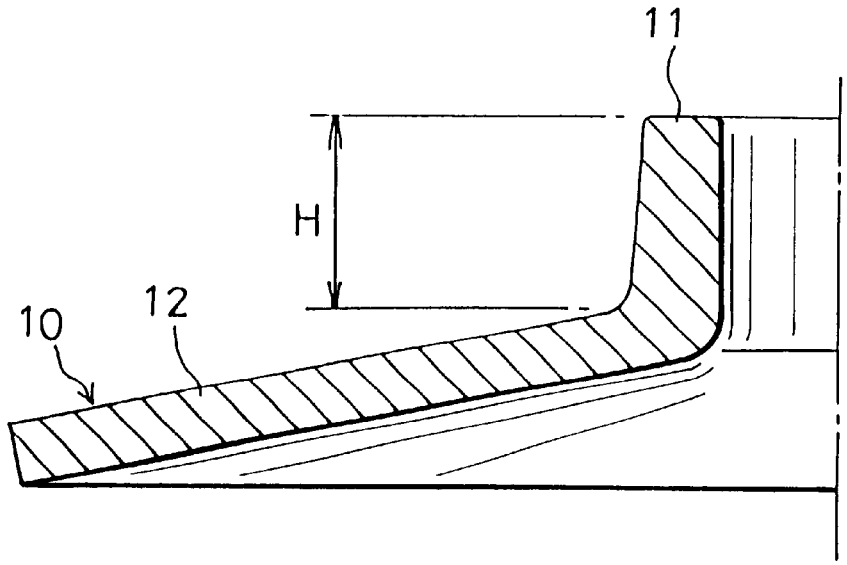
FIG. 1 is a partial section view of a sheet metal member having a cylindrical portion.

FIG. 1 shows a sheet metal member 10 having a cylindrical portion 11. In the sheet metal member 10, the cylindrical portion 11 is formed at the center of a circular plate portion 12 which is slightly inclined in a conical manner. The cylindrical portion 11 is formed by punching out a circular shape at the center of the plate portion 12 to form a circular hole, and then conducting a drawing process on the periphery of the circular hole. Alternatively, the illustrated cylindrical portion 11 may be formed by conducting a burring process on the center of the plate portion 12. The cylindrical portion 11 of the sheet metal member 10 shown in FIG. 1 has a large height, and the axial length of the cylindrical portion is indicated by a reference numeral H.

In the method of forming an inner flange of the embodiment of the present invention, a step is conducted in which the axial length of the cylindrical portion 11 is reduced by pressing the cylindrical portion 11 in the axial direction of the cylindrical portion and an excess portion produced as a result of the reduction of the axial length of the cylindrical portion 11 is caused to flow to the basal end part of the axial direction of the cylindrical portion 11, thereby projecting the excess portion into the inside of the cylindrical portion 11. In the illustrated method, this step is carried out in plural stages.

Figure 2:
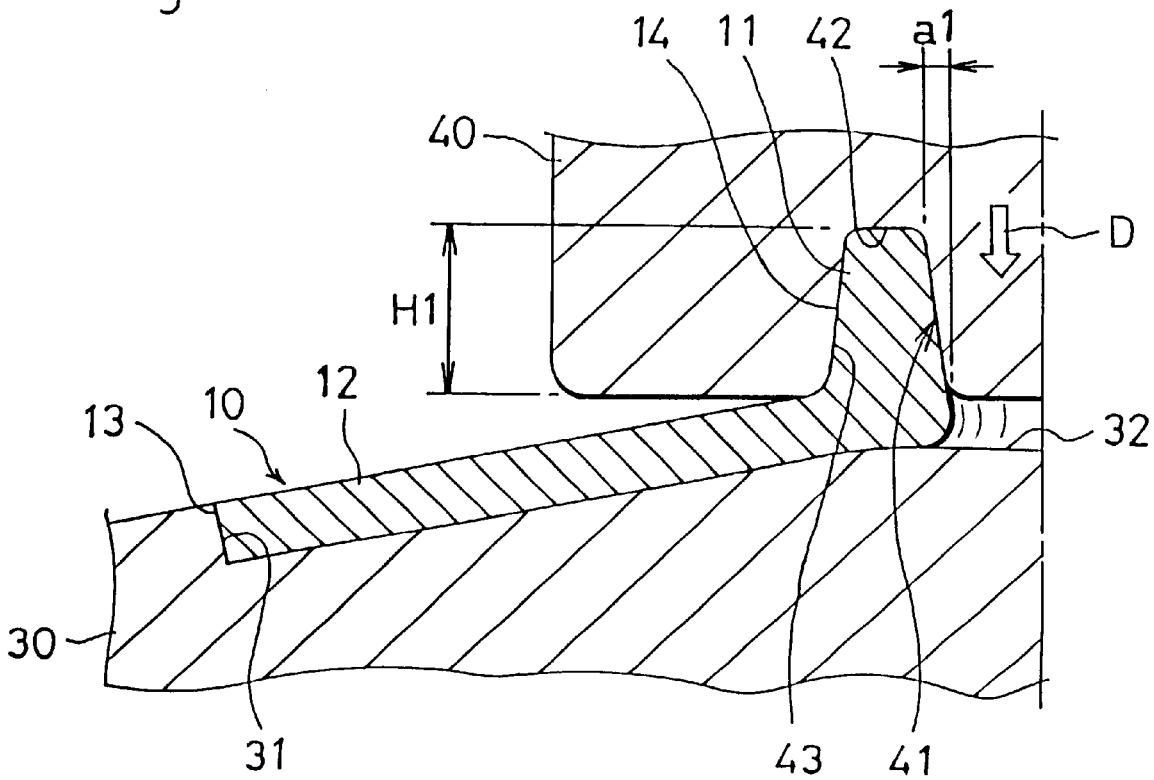
FIG. 2 is a view showing a partial section to illustrate a first stage of a step of forming an inner flange.

FIG. 2 shows a first stage of the step. In this stage, a first support die 30 and a first pressing die 40 are used. The sheet metal member 10 is placed on the first support die 30 and the whole periphery of the outer peripheral end face 13 of the plate portion 12 is supported by a support face 31 formed in the first support die 30. The first support die 30 has a second die face 32 which is configured by a horizontal support face. The back face of the center portion of the sheet metal member 10 is supported by the second die face 32. By contrast, the first pressing die 40 comprises an annular recess 41 which is recessed by a dimension that is slightly shorter than the axial length H of the cylindrical portion 11 described with reference to FIG. 1. The upper wall face of the recess 41 serves as a pressing face 42. The recess 41 has a size which enables the cylindrical portion 11 described with reference to FIG. 1 to be fitted into the recess. When the cylindrical portion 11 described with reference to FIG. 1 is fitted into the recess 41, the outer peripheral face 14 of the cylindrical portion 11 is supported by a first die face 43 which is formed by the outer peripheral face of the recess 41.

The sheet metal member 10 is placed on the first support die 30 of FIG. 2, the whole periphery of the outer peripheral end face 13 of the plate portion 12 is supported by a support face 31 of the first support die 30, and the back face of the center portion of the sheet metal member 10 is supported by the second die face 32 of the first support die 30. Thereafter, the first pressing die 40 is lowered from the upper side. As a result, the cylindrical portion 11 is fitted into the recess 41 of the first pressing die 40. Under this state, a load is applied to the first pressing die 40 so as to push down the first pressing die 40 as shown by the arrow D. Then, under the state where deformation of the outer peripheral face 14 of the cylindrical portion 11 is blocked by the first die face 43 and that of the end face of the basal end part (the end face on the side of the lower end) of the cylindrical portion 11 is blocked by the second die face 32, the cylindrical portion 11 is pressed in the axial direction by the pressing face 42. The pressing force exerted at this time causes the axial length H1 of the cylindrical portion 11 to be reduced to a value which is equal to the depth of the recess 41. Parallel with this reduction, an excess portion produced as a result of the reduction of the axial length of the cylindrical portion 11 projects into the inside of the cylindrical portion 11. In FIG. 2, the width of the projection of the excess portion in this case is indicated by a reference numeral a1.

Figure 3:
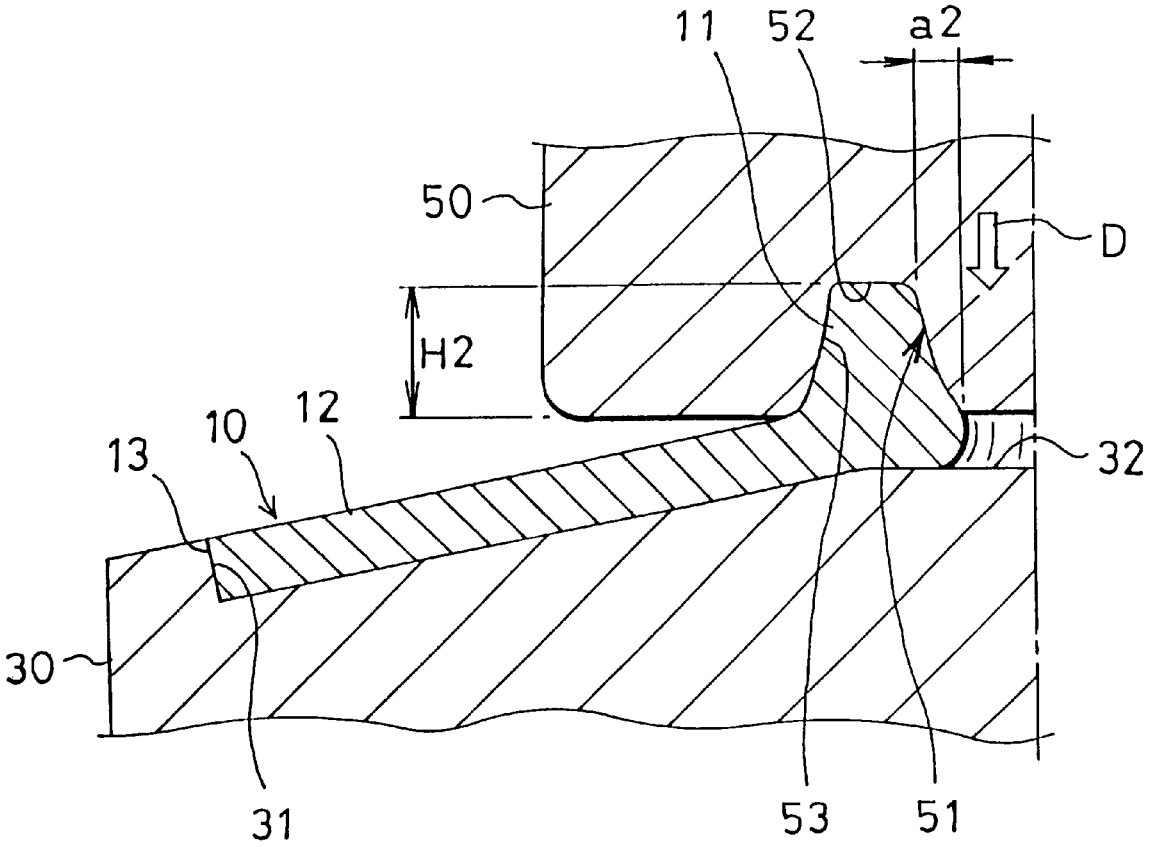
FIG. 3 is a view showing a partial section to illustrate a second stage of the step of forming an inner flange.

FIG. 3 shows a second stage of the step. In this stage, the first support die 30 which is identical with that described with reference to FIG. 2 is continuously used, and a second pressing die 50 is used in place of the first pressing die 40 described with reference to FIG. 2. The second pressing die 50 comprises an annular recess 51 which is recessed by a dimension H2 that is slightly shorter than the axial length H1 of the cylindrical portion 11 reduced by conducting the first stage described with reference to FIG. 2. The upper wall face of the recess 51 serves as a pressing face 52. The recess 51 has a size which enables the cylindrical portion 11 that has undergone the first stage described with reference to FIG. 2, to be inserted into the recess. When the cylindrical portion 11 that has undergone the first stage is fitted into the recess 51, the outer peripheral face 14 of the cylindrical portion 11 is supported by the first die face 53 which is formed by the outer peripheral face of the recess 51. The first die face 43 shown in FIG. 2 and the first die face 53 of FIG. 3 are in common with each other in that they exert a function of supporting the outer peripheral face 14 of the cylindrical portion 11 to prevent the face from being deformed.

When the second pressing die 50 is lowered from the upper side, the cylindrical portion 11 is fitted into the recess 51 of the second pressing die 50. Under this state, a load is applied to the second pressing die 50 so as to push down the second pressing die as shown by the arrow D. Then, under the state where deformation of the outer peripheral face 14 of the cylindrical portion 11 is blocked by the first die face 53 and that of the end face of the basal end part (the end face on the side of the lower end) of the cylindrical portion 11 is blocked by the second die face 32, the cylindrical portion 11 is pressed in the axial direction by the pressing face 52. The pressing force exerted at this time causes the axial length H2 of the cylindrical portion 11 to be reduced to a value which is equal to the depth of the recess 51. Parallel with this reduction, an excess portion produced as a result of the reduction of the axial length of the cylindrical portion 11 projects into the inside of the cylindrical portion 11. In FIG. 3, the width of the projection of the excess portion in this case is indicated by a reference numeral a2.

In the first stage described with reference to FIG. 2 and the second stage described with reference to FIG. 3, the excess portion is gradually gathered to the basal end part of the cylindrical portion 11 in parallel with the projection into the inside of the cylindrical portion 11. As closer to the basal end part thereof, therefore, the excess portion projects inwardly by a larger degree.

Figure 4:
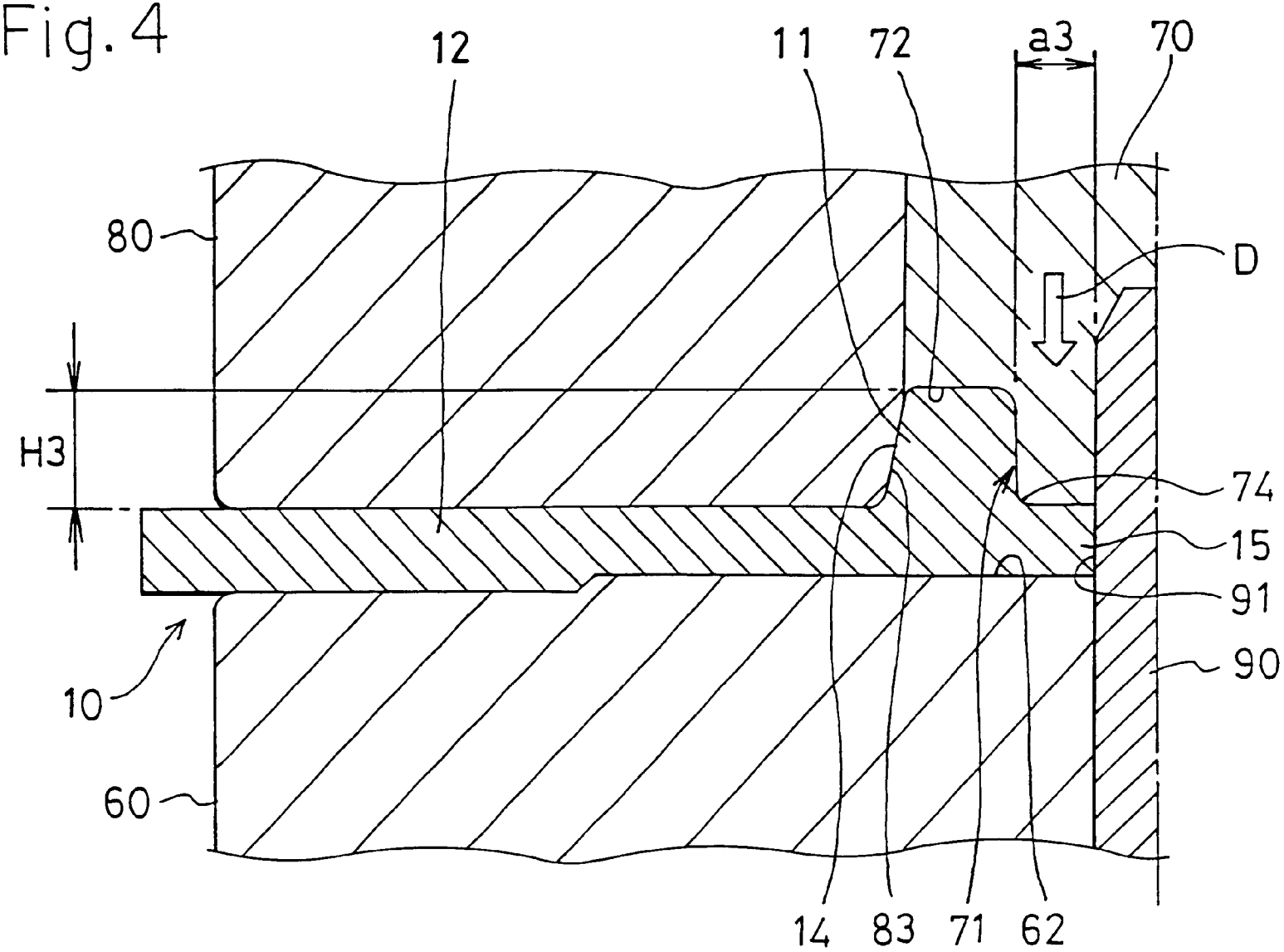
FIG. 4 is a view showing a partial section to illustrate a third stage of the step of forming an inner flange.

FIG. 4 shows a third stage, i.e., the final stage of the step. In this stage, a second support die 60, a third pressing die 70, and a first outer die 80 are used. The sheet metal member 10 which has undergone the second stage described with reference to FIG. 3 is placed on the second support die 60. The second support die 60 has a second die face 62 which is configured by a horizontal support face. The back face of the center portion of the sheet metal member 10 is supported by the second die face 62. The second die face 32 shown in FIGS. 2 and 3 and the second die face 62 of FIG. 4 are in common with each other in that they exert a function of supporting the back face of the center portion of the sheet metal member 10 to prevent the end face of the basal end part of the cylindrical portion 11 from being deformed. By contrast, the third pressing die 70 and the first outer die 80 cooperate with each other so as to form an annular recess 71 which is recessed by a dimension that is slightly shorter than the axial length H2 of the cylindrical portion 11 which has undergone the second stage described with reference to FIG. 3. The upper wall face of the recess 71 serves as a pressing face 72. The recess 71 has a size which enables the cylindrical portion 11 which has undergone the second stage to be fitted into the recess. When the cylindrical portion 11 which has undergone the second stage in FIG. 3 is fitted into the recess 71, the outer peripheral face 14 of the cylindrical portion 11 is supported by a first die face 83 which is formed by the outer peripheral face of the recess 71. The first die faces 43 and 53 shown in FIGS. 2 and 3 and the first die face 83 of FIG. 4 are in common with each other in that they exert a function of supporting the back face of the center portion of the sheet metal member 10.

The sheet metal member 10 which has undergone the second stage is placed on the second support die 60 of FIG. 4, the back face of the center portion of the sheet metal member 10 is supported by the second die face 62 of the second support die 60, and the plate portion 12 of the sheet metal member 10 is pressed by the first outer die 80. When the third pressing die 70 is thereafter lowered from the upper side, the cylindrical portion 11 is fitted into the recess 71 which is formed by cooperation of the first outer die 80 and the third pressing die 70. Under this state, a load is applied to the third pressing die 70 so as to push down the third pressing die as shown by the arrow D. Then, under the state where deformation of the outer peripheral face 14 of the cylindrical portion 11 is blocked by the first die face 83 and that of the end face of the basal end part (the end face on the side of the lower end) of the cylindrical portion 11 is blocked by the second die face 62, the cylindrical portion 11 is pressed in the axial direction by the pressing face 72. The pressing force exerted at this time causes the axial length H3 of the cylindrical portion 11 to be reduced to a value which is equal to the depth of the recess 71. Parallel with this reduction, an excess portion produced as a result of the reduction of the axial length of the cylindrical portion 11 projects into the inside of the cylindrical portion 11. In FIG. 4, the width of the projection of the excess portion in this case is indicated by a reference numeral a3.

In the final stage of FIG. 4, the basal end part of the cylindrical portion 11, and the root part of the excess portion which is gathered to the basal end part of the cylindrical portion 11 to project inwardly are formed in a substantially perpendicular relationship. Specifically, the third pressing die 70 comprises a shaping face 74 which is substantially perpendicular, and the basal end part of the cylindrical portion 11 and the root part of the excess portion are pressed by the shaping face 74.

In the third stage of the step, as shown in FIG. 4, a column-like core 90 is concentrically inserted into the cylindrical portion 11. The end face of the inward projected part of the excess portion on the inner peripheral side is pressed against a shaping face 91 of the core 90. According to this configuration, the inner peripheral end face of the inner flange 15 which is formed by the excess portion is finished smoothly and highly accurately.

Figure 8:
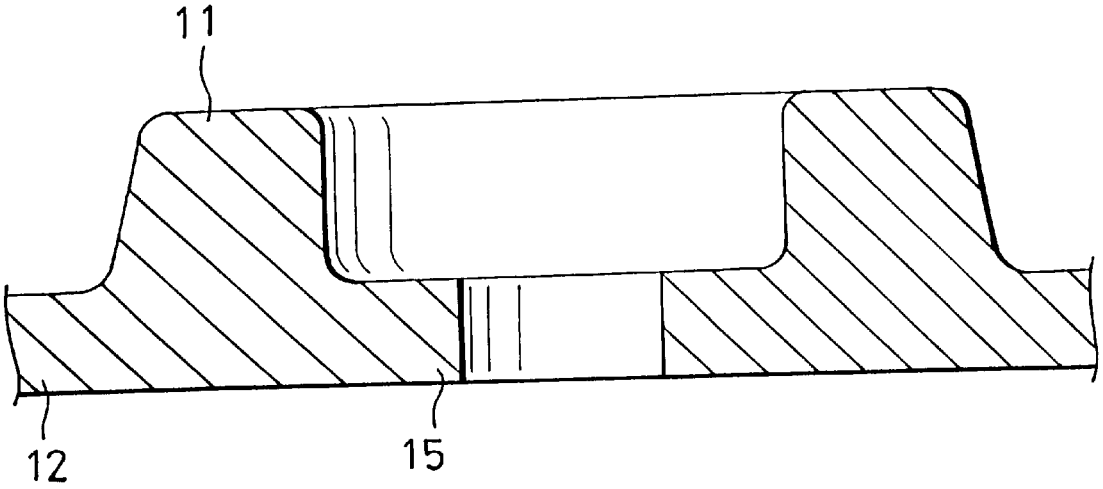
FIG. 8 is a section view showing main portions of a sheet metal member having an inner flange.
Figure 9:
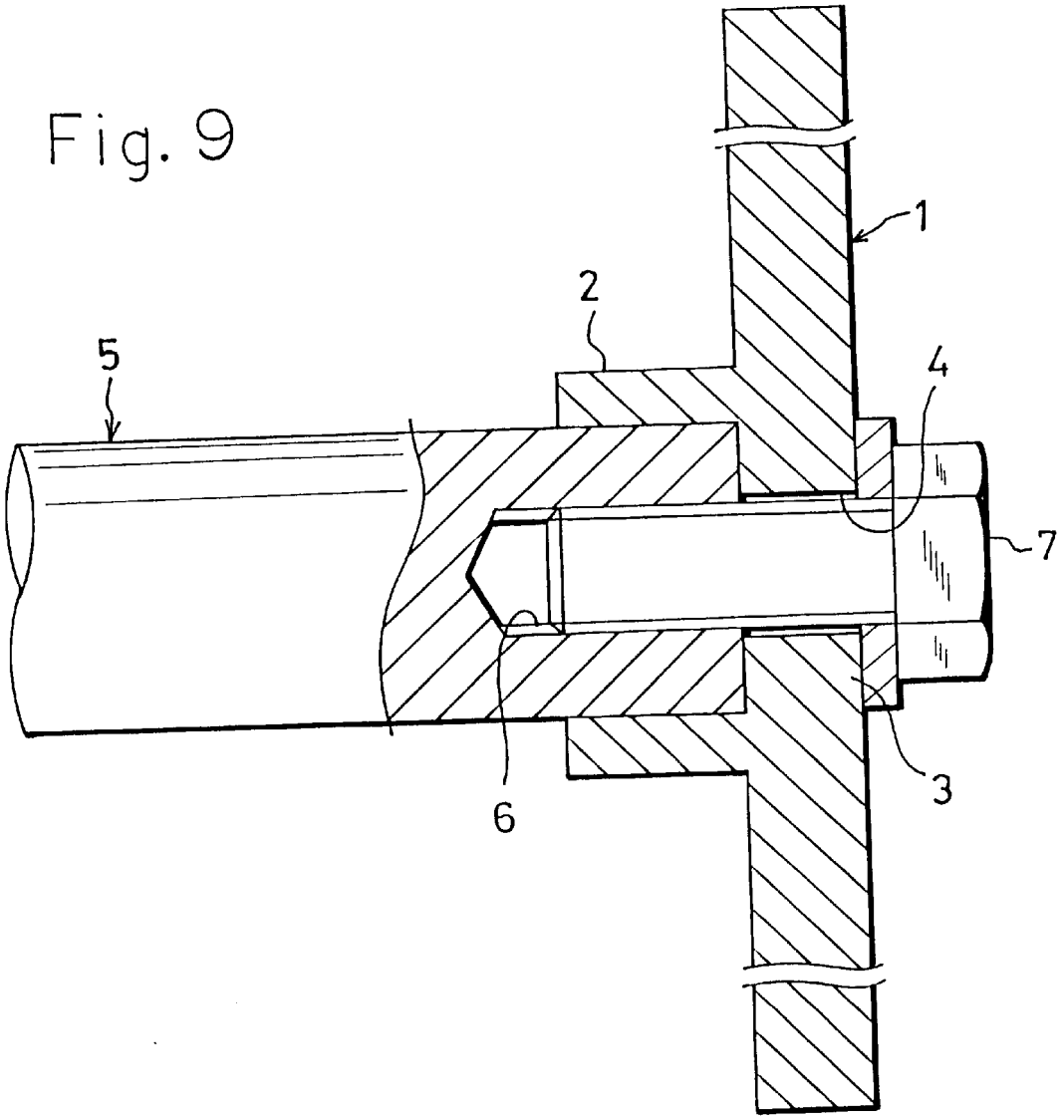
FIG. 9 is a view illustrating a use state of a member having an inner flange.

FIG. 8 shows main portions of the sheet metal member 10 which has undergone the above-described stages. As shown in the figure, the sheet metal member 10 has the boss-like cylindrical portion 11 at the center of the circular plate portion 12, and the inner flange 15 which is formed by the excess portion is disposed in the basal end part of the cylindrical portion 11. A gear or a pulley V-groove may be freely formed in the outer periphery of the sheet metal member 10.

The first support die 30, the first pressing die 40, the second pressing die 50, the second support die 60, the third pressing die 70, the first outer die 80, and the like dies which have been described with reference to FIGS. 2 to 4 correspond to pressing dies attached to a press machine. Among these dies, the first pressing die 40, the second pressing die 50, and the third pressing die 70 are moved in the axial direction of the cylindrical portion 11.

In the embodiment described above, the pressing process in the inner flange forming step is conducted in several stages. Depending on the material of the sheet metal member 10, these stages may be conducted as a single stage. The sheet metal member 10 used in the embodiment is made of SAPH440 (high tension steel). When the pressing process is conducted in several stages as described above, the finished shape of the inner flange 15 is highly accurate.

Figure 5:
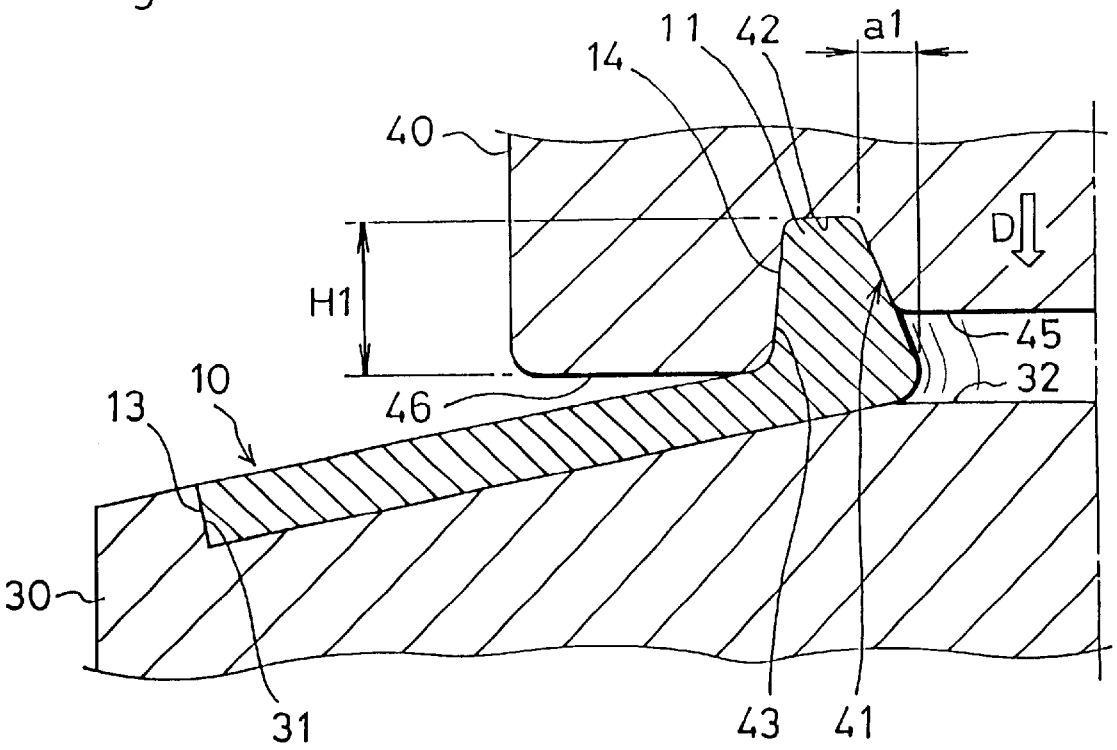
FIG. 5 is a view showing a partial section to illustrate a first stage of a step of forming an inner flange which is suitable for a sheet metal member having a cylindrical portion of a large diameter.
Figure 6:
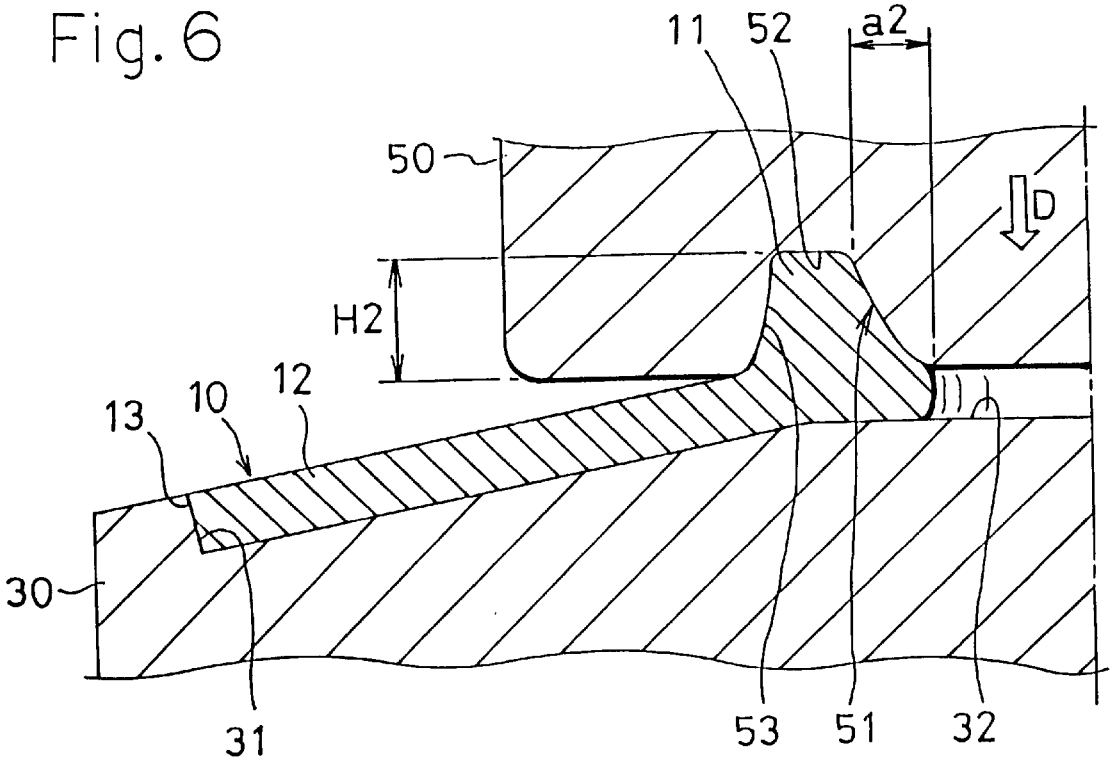
FIG. 6 is a view showing a partial section to illustrate a second stage of the step of forming an inner flange which is suitable for a sheet metal member having a cylindrical portion of a large diameter.
Figure 7:
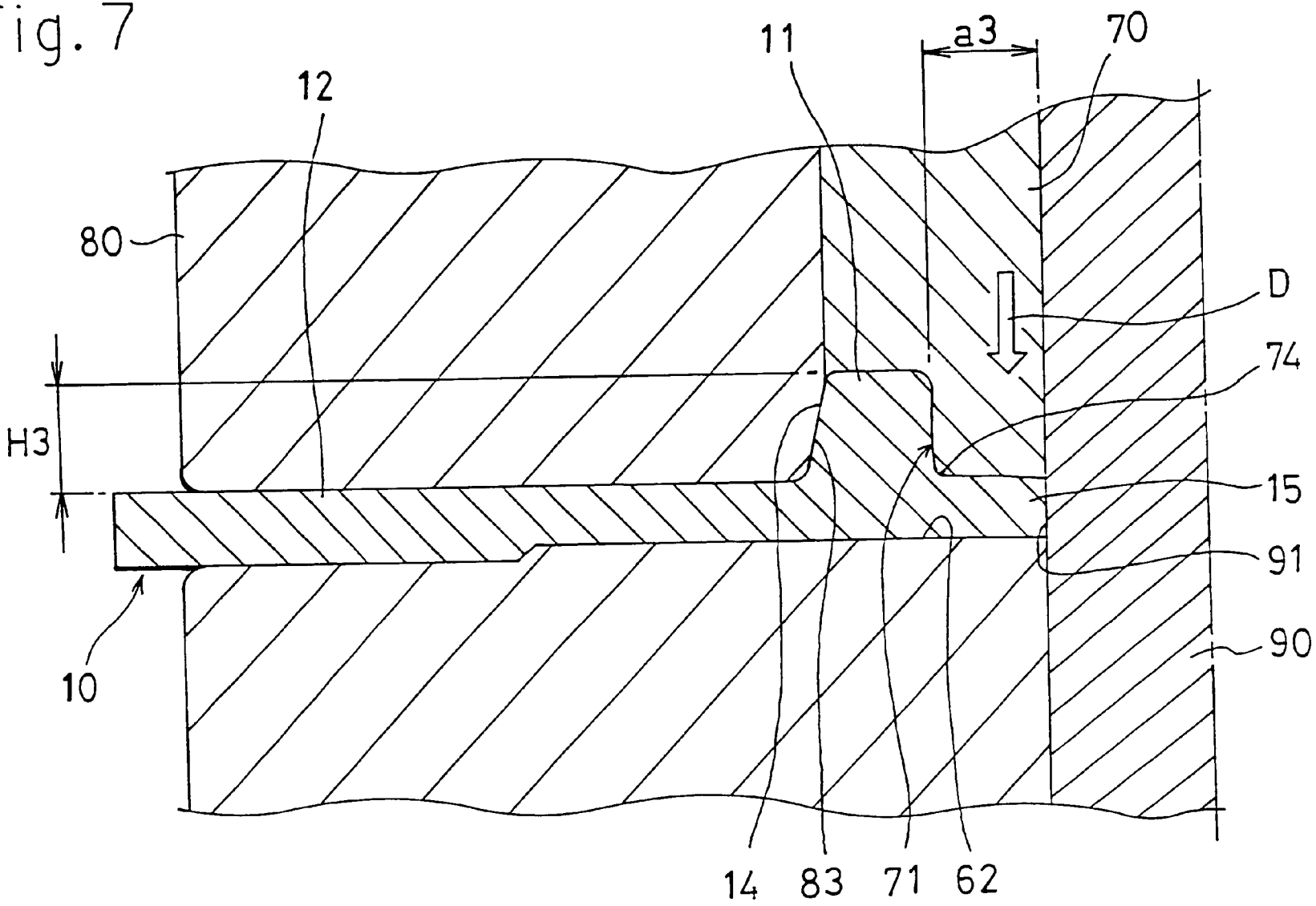
FIG. 7 is a view showing a partial section to illustrate a third stage of the step of forming an inner flange which is suitable for a sheet metal member having a cylindrical portion of a large diameter.

FIGS. 5 to 7 show a method which is suitable for formation of the inner flange 15 in the sheet metal member 10 having the cylindrical portion 11 of a large diameter. FIG. 5 shows the first stage corresponding to FIG. 2, FIG. 6 the second stage corresponding to FIG. 3, and FIG. 7 the third stage corresponding to FIG. 4.

In this method, the first pressing die 40 used in the first stage of FIG. 5 is different from the die shown in FIG. 2 in that a lower face 45 which is inside the recess 41 is positioned at a level slightly higher than that of a lower face 46 which is outside the recess. The other components are identical with those described with reference to FIGS. 1 to 4. Therefore, identical or corresponding components are designated by the same reference numerals and their detailed description is omitted.

The entire disclosure of Japanese Patent Application No. 9-12561 filed on Jan. 27, 1997 including specification, claims, drawings and summary are incorporated herein by reference in its entirety.

What is claimed is:

1. A method of forming an inner flange on a sheet metal member having a cylindrical portion, the cylindrical portion having an outer peripheral face, a basal end part, a given axial length defining an axial direction, and an inside, comprising the steps of: pressing the cylindrical portion in the axial direction of the cylindrical portion to reduce the axial length of the cylindrical portion using a pressing die moving in the axial direction of the cylindrical portion; blocking deformation of the outer peripheral face of the cylindrical portion by a first die face formed on the pressing die; blocking deformation of an end face of the basal end part of the cylindrical portion by a second die face formed on the pressing die; and allowing excess metal to project into the inside of the cylindrical portion, thereby forming an inner flange.

2. A method of forming an inner flange on a sheet metal member having a cylindrical portion according to claim 1, wherein a place into which the excess metal projects is the basal end part in the axial direction of the cylindrical portion.

3. A method of forming an inner flange on a sheet metal member having a cylindrical portion according to claim 2, wherein the cylindrical portion is a cylindrical boss.

4. A method of forming an inner flange on a sheet metal member having a cylindrical portion according to claim 2, further comprising the step of: inserting a core into the cylindrical portion, and wherein an end face of the projected part of the excess metal on an inner peripheral side is pressed against a shaping face of the core.

5. A method of forming an inner flange on a sheet metal member having a cylindrical portion according to claim 2, wherein said step of pressing said cylindrical portion in the axial direction is conducted in plural stages.

6. A method of forming an inner flange on a sheet metal member having a cylindrical portion according to claim 1, wherein the cylindrical portion is a cylindrical boss.

7. A method of forming an inner flange on a sheet metal member having a cylindrical portion according to claim 1, further comprising the step of: inserting a core into the cylindrical portion, and wherein an end face of the projected part of the excess metal on an inner peripheral side is pressed against a shaping face of the core.

8. A method of forming an inner flange on a sheet metal member having a cylindrical portion according to claim 1, wherein said step of pressing said cylindrical portion in the axial direction is conducted in plural stages.

* * * * *